US006735872B1

(12) United States Patent
Chang

(10) Patent No.: US 6,735,872 B1
(45) Date of Patent: May 18, 2004

(54) CUTTER KNIFE

(76) Inventor: Man-Chi Chang, No. 7, Lane 67, Tai-Ming Road, We-Jih Hsiang, Taichung Hsien (TW)

( * ) Notice: Subject to any disclaimer, the term of this patent is extended or adjusted under 35 U.S.C. 154(b) by 0 days.

(21) Appl. No.: 10/395,158

(22) Filed: Mar. 25, 2003

(51) Int. Cl.[7] ..... B26B 1/08
(52) U.S. Cl. ..... 30/162; 30/125; 30/335
(58) Field of Search ..... 30/162, 335, 336, 30/125

(56) References Cited

U.S. PATENT DOCUMENTS 3,660,896 A * 5/1972 Umholtz ..... 30/162
6,192,589 B1 * 2/2001 Martone et al. ..... 30/125
6,513,246 B2 * 2/2003 Ping ..... 30/125
6,553,674 B1 * 4/2003 Budrow ..... 30/162
2002/0029480 A1 * 3/2002 Lin ..... 30/125

* cited by examiner

*Primary Examiner*—Douglas D. Watts
(74) *Attorney, Agent, or Firm*—Rosenberg, Klein & Lee

(57) ABSTRACT

An improved cutter knife and particularly to a cutter knife allowing positive and inverse gripping when in use consists of an upper shell and a lower shell that are coupled to form a body. The body has one end forming a handgrip conforming to ergonomics to allow positive and inverse gripping. The handgrip has a blade anchor section and a blade fast change section on one end to allow positive or inverse gripping and fast replacement of the blade. The positive gripping may be used for ordinary cutting such as for paper or cloths. The inverse gripping may be used for heavy duty cutting with a greater force such as for cardboard or wooden laminates. Thus it provide dual functions and may be used conveniently to overcome the limitation of conventional cutter knives that allow only positive gripping.

3 Claims, 7 Drawing Sheets

CUTTER KNIFE

BACKGROUND OF THE INVENTION

1. Field of the Invention

The invention relates to an improved cutter knife and particularly to a cutter knife allowing positive and inverse gripping when in use.

2. Description of the Prior Art

Conventional cutter knives such as the one shown in FIG. 1 mainly has a handgrip 11 on the body 1. The handgrip 11 has a sliding button 12 on one end to extend or retract a blade 13 outside or inside the body 1 for cutting use. Although such a structure can meet ordinary requirements such as cutting paper or cloths, the design of the body and blade does not allow them to be gripped in inverse, thus is not suitable for heavy duty cutting tasks for articles that have a greater thickness or hardness (such as thick cardboard, plywood, wooden laminates, or the like). As a result, it is difficult to apply a greater force to do the cutting task. Moreover, the blade cannot be turned in different direction or replaced. Its utilization is limited. Users often have to prepare many different types of cutter knives to meet the possible requirements. It not only cannot fully meet user's needs, also results in waste of resources.

SUMMARY OF THE INVENTION

In view of the aforesaid disadvantages, the primary object of the invention is to provide a cutter knife that adopts ergonomic design to provide positive and inverse gripping so that it can be used to cut ordinary paper or thick cardboard and plywood.

Another object of the invention is to provide a cutter knife that allows the blade to be replaced rapidly or transformed according to requirements.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
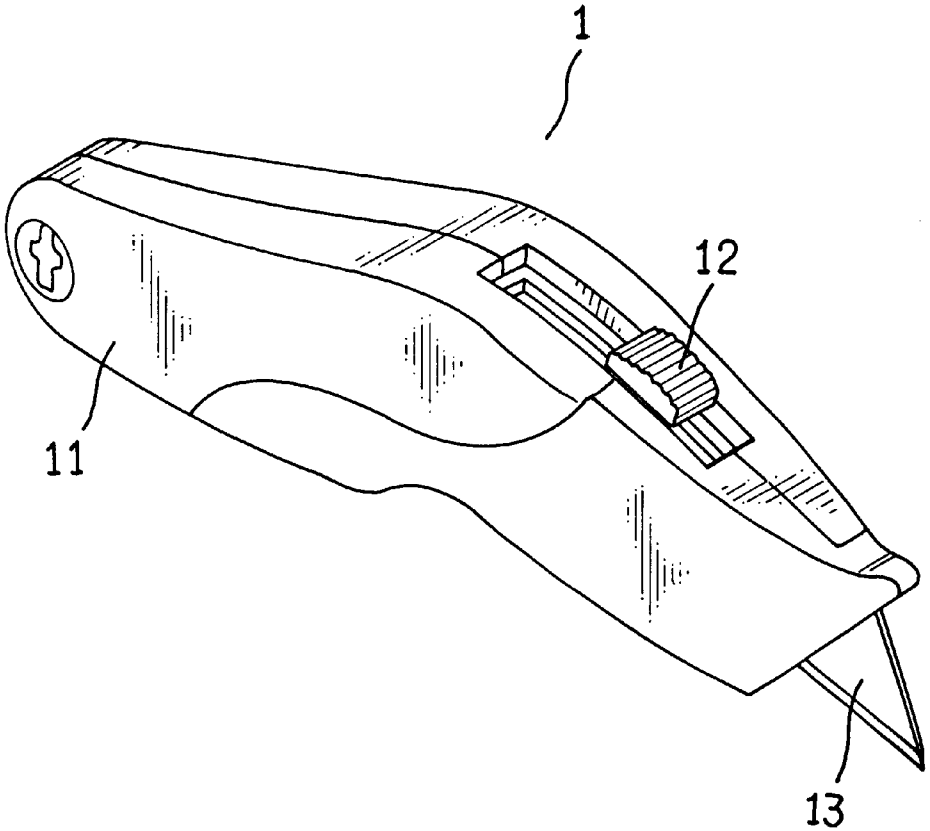
FIG. 1 PRIOR ART
FIG. 1 is a perspective view of a conventional cutter knife.
Figure 2:
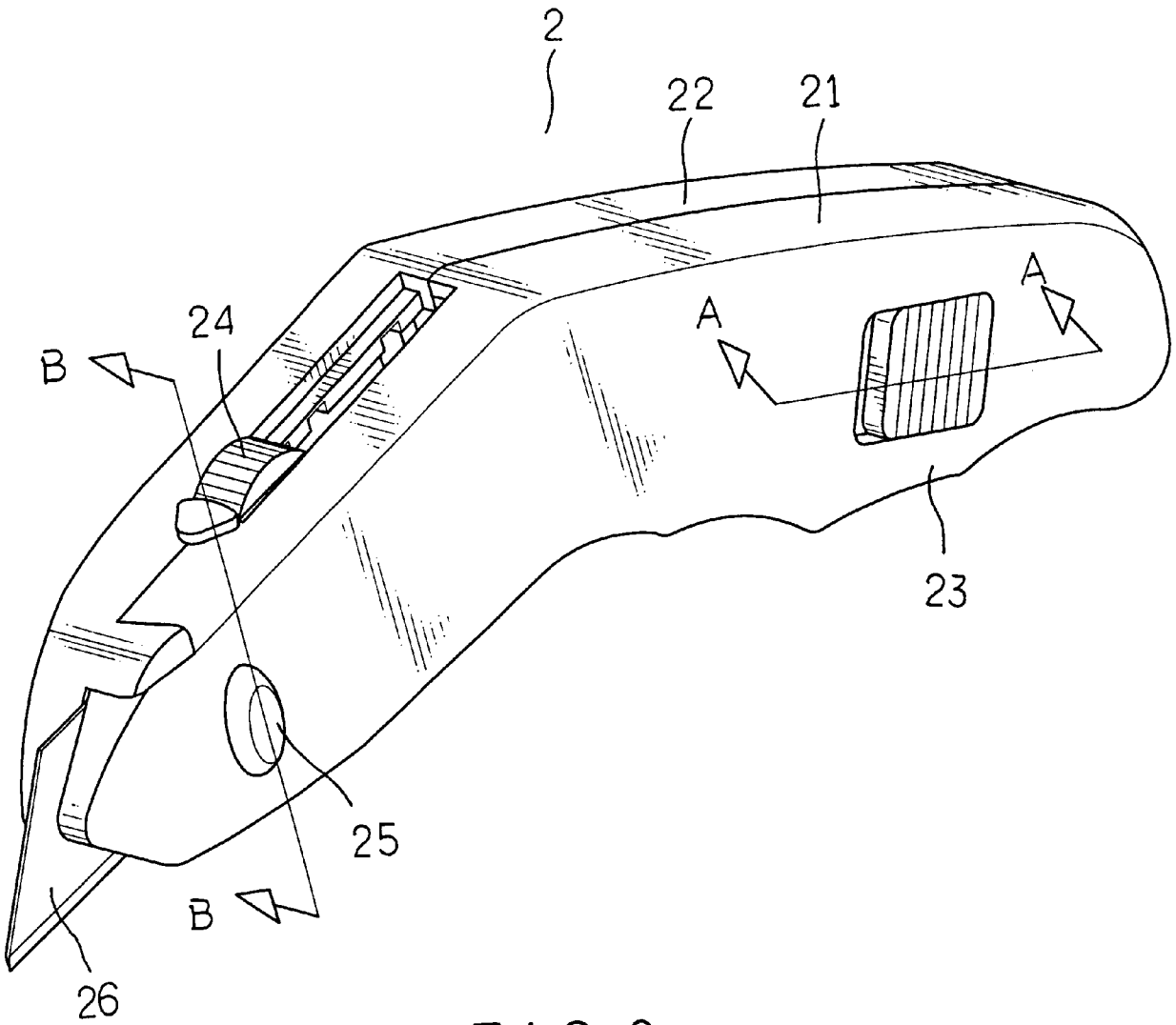
FIG. 2 is a perspective view of the invention.
Figure 3:
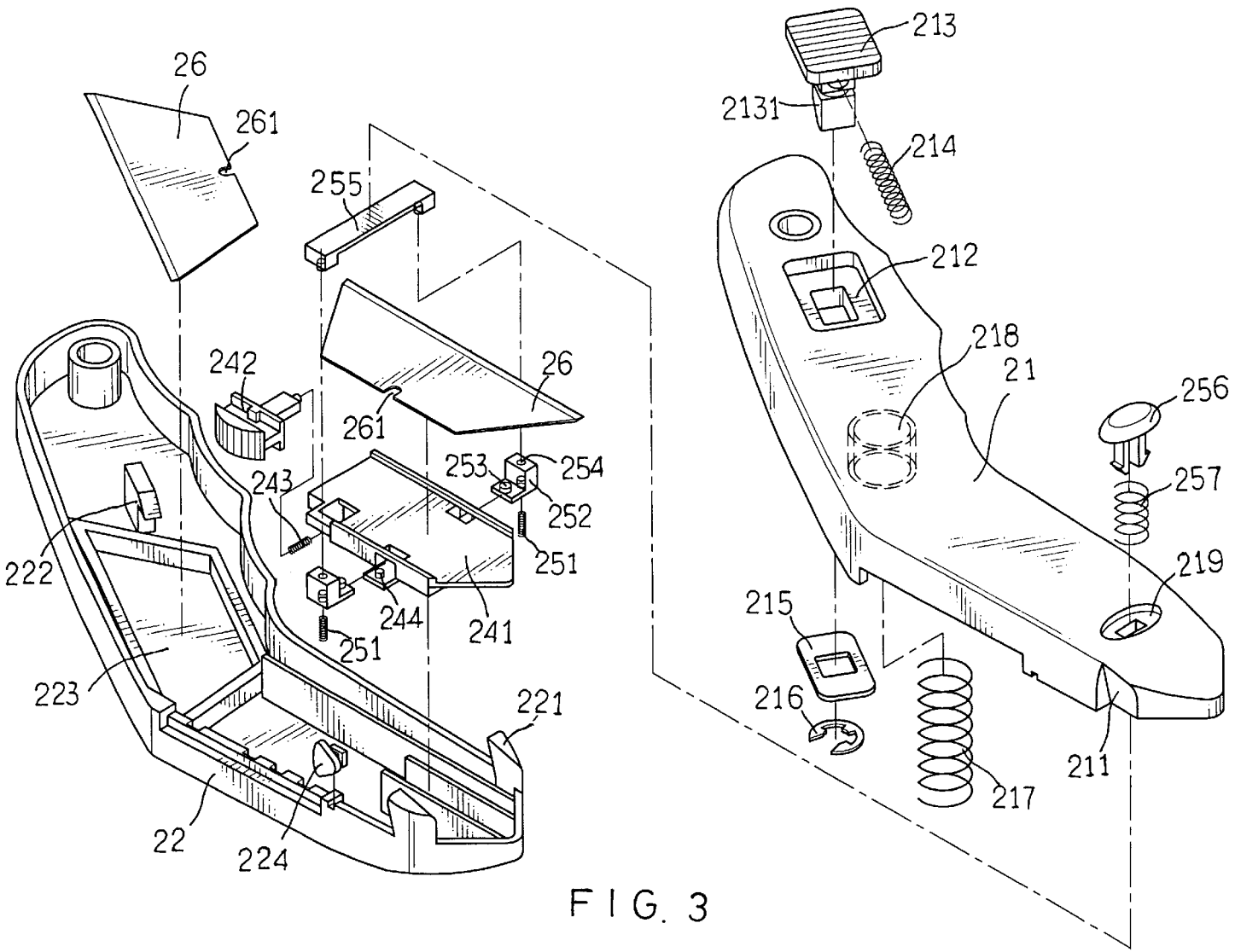
FIG. 3 is an exploded view of the invention.

Referring to FIGS. 2 and 3, the cutter knife of the invention has a body 2 which consists of an upper shell 21 and a lower shell 22. The body has a handgrip 23 at one end that is designed conforming to ergonomics to enable users to grip in a positive or inverse manner. The handgrip 23 has another end housing a blade anchor section 24 and a blade fast change section 25.

The upper shell 21 has a front end forming a latch end 211 to couple with the lower shell 22 and another end remote from the latch end 211 forming an aperture 212 to couple with a coupling section 213. The coupling section 213 has a latch strut 2131 located on the bottom end thereof to latch a hook 222 located on the lower shell 22. The coupling section 213 engages with a return spring 214. Moreover, the coupling section 213 is retained in the upper shell 21 by means of a washer 215 and a C-shaped clip 216.

The lower shell 22 has a latch member 221 located at the front end to couple with the latch end 211 of the upper shell 21. In addition, the hook 222 of the lower shell 22 may couple with the coupling strut 2131 of the coupling section 213 of the upper shell 21 to form a secure coupling. The lower shell 22 has a store compartment 223 for holding a blade 26. The store compartment 223 has an upper rim in contact with a spring 217. The spring 217 is held in a hub 218 formed in the upper shell 21. The lower shell 22 further has a retaining block 224.

The blade anchor section 24 has a blade trough 241 housed in the body 2. The blade trough 241 may hold the blade 26. The blade trough 241 has one end engaged with a sliding button 242. The sliding button 242 has a bottom end coupling with a spring 243.

The blade fast change section 25 is located above the blade anchor section 24. The blade trough 241 has two sides extending outwards to form two lugs 244 which couple respectively with a spring 251. The springs 251 further couple with a pair of L-shaped bucking members 252. Each of the bucking members 252 has a stub 253 which may latch on a notch 261 formed on the blade 26. The bucking member 252 has another end apart from the stub 253 forming a coupling hole 254 for coupling with one of two ends of a beam 255. The beam 255 may be depressed through a control button 256 located thereabove. There is a spring 257 located below the control button 256 and is confined in a hole 219 formed on the upper shell 21.

Figure 5:
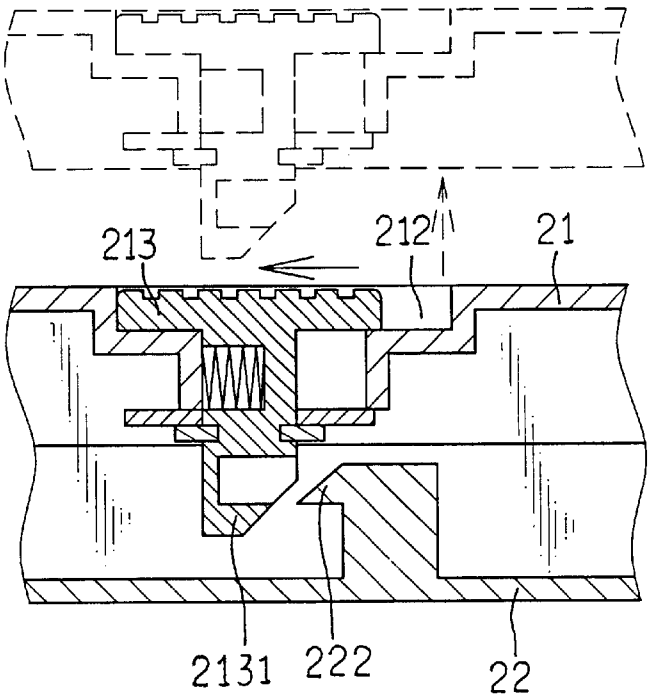
FIG. 5 is a cross section taken on line A—A in FIG. 2 before assembled.
Figure 4:
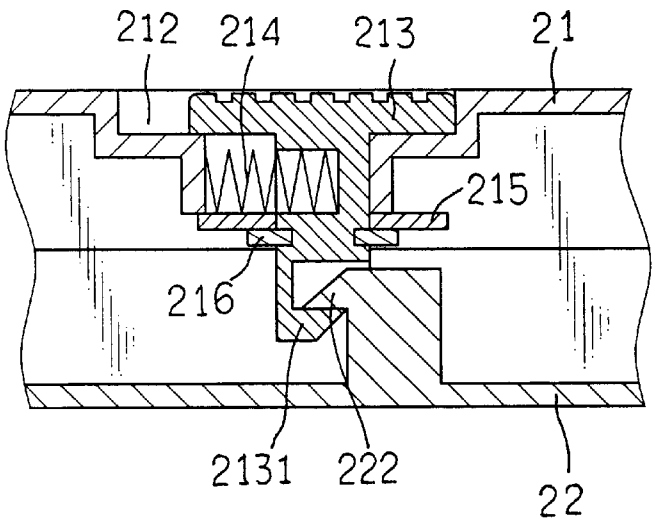
FIG. 4 is a cross section taken on line A—A in FIG. 2 after assembled.

Referring to FIGS. 4 and 5, for assembly of the body 2, couple the upper shell 21 with the lower shell 22 by depressing the upper shell 21 such that the coupling strut 2131 at the bottom end of the coupling section 213 is latched on the hook 222 of the lower shell 22 to form a latched condition. For disassembly of the body 2, move the coupling section 213 forwards (shown by an arrow in FIG. 5), the coupling strut 2131 may be separated from the hook 222, and the spring 217 pushes the upper shell 21 away from the lower shell 22 to separate the two.

Figure 6:
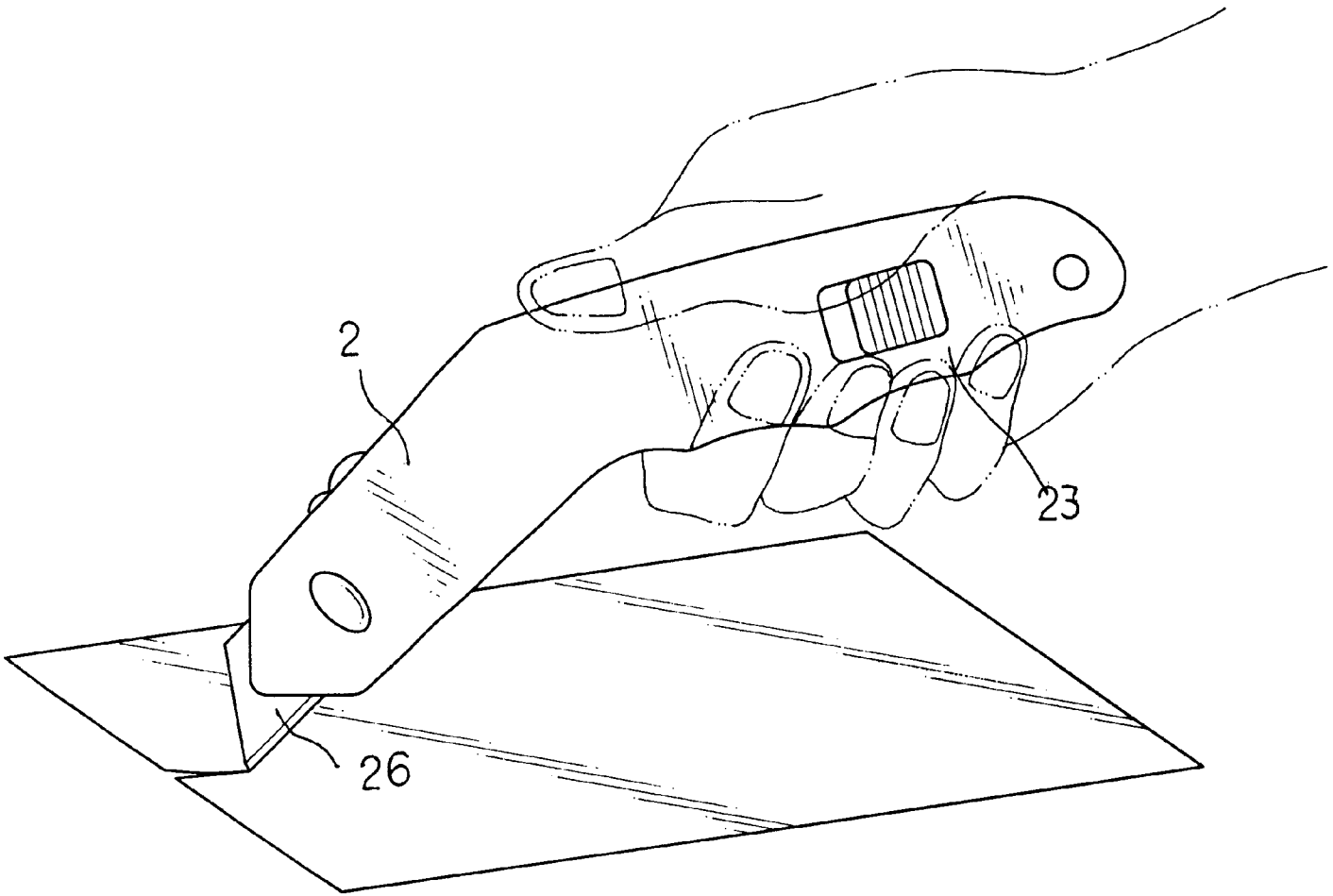
FIG. 6 is a schematic view of the invention in use for positive gripping and cutting.
Figure 8:
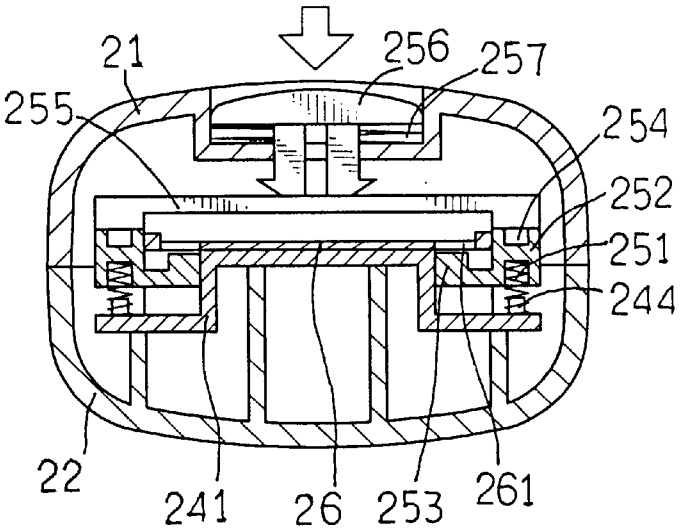
FIG. 8 is a cross section taken on line B—B in FIG. 2 under depressing.
Figure 7:
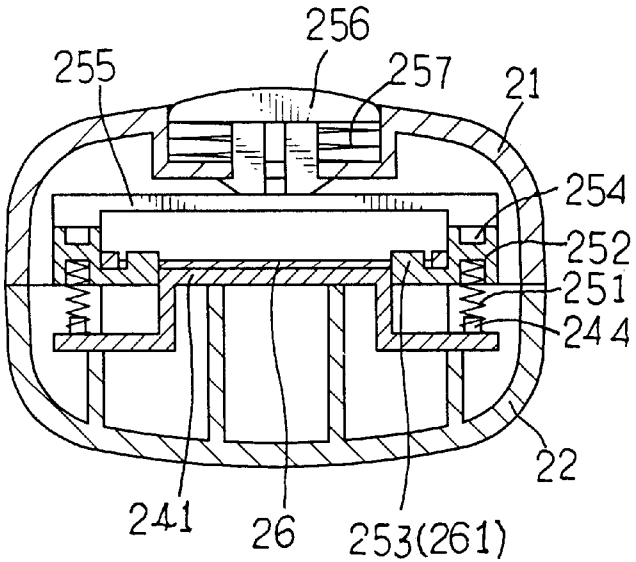
FIG. 7 is a cross section taken on line B—B in FIG. 2 before depressing.
Figure 9:
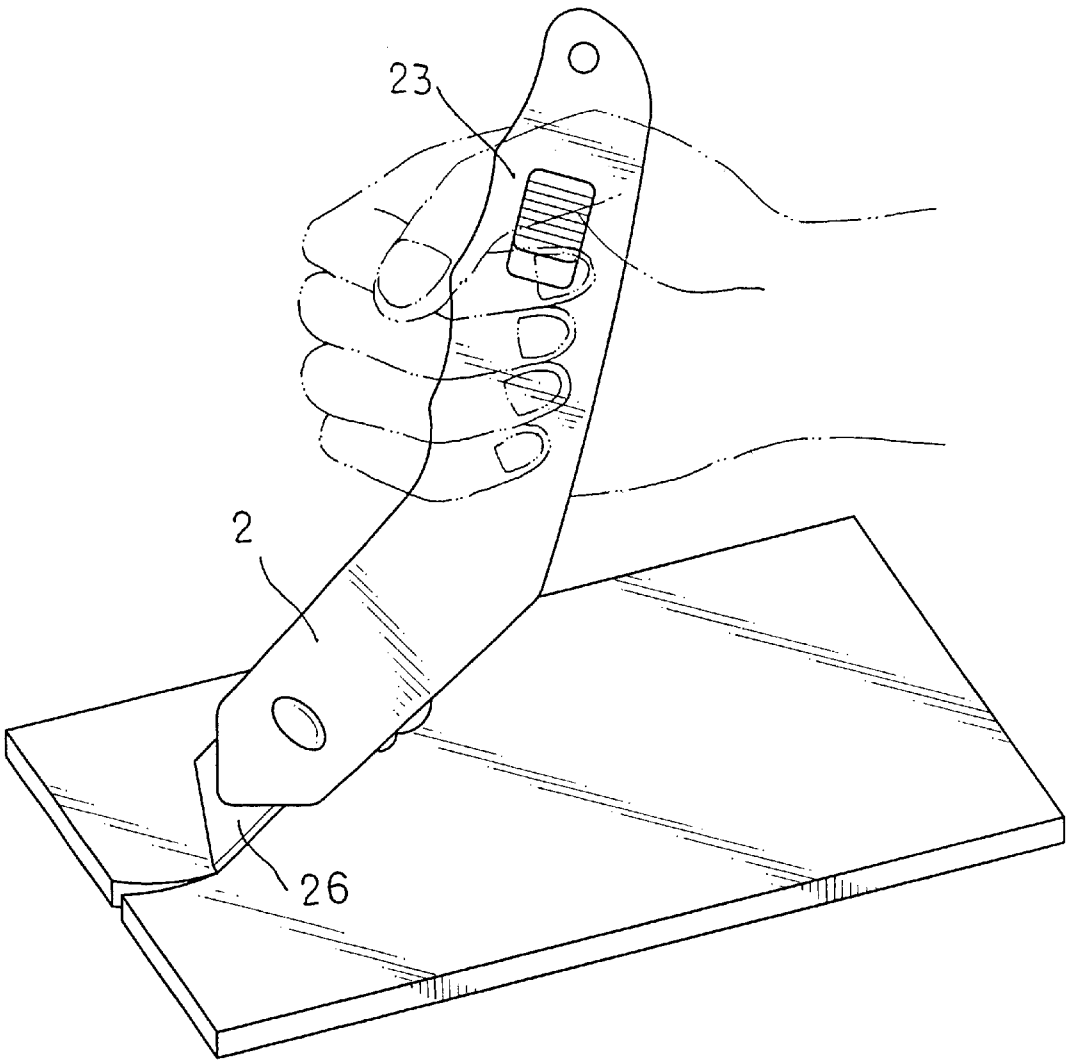
FIG. 9 is a schematic view of the invention in use for inverse gripping and cutting.

Referring to FIG. 6, when in use, push the sliding button 242 of the blade anchor section 24 to extend the tip and edge of the blade 26 outside the body 2. The sliding button 242 is anchored by the retaining block 224. Thus the cutter knife forms a general positive gripping position for use. Referring to FIGS. 7 and 8, when the blade of the blade 26 is blunt and to change a new blade is required, depress the control button 256 of the blade fast change section 25 to move the beam 255 downwards, the bucking member 252 and the stub 253 also are moved downwards to escape the notch 261 of the blade 26. Thus the blade 26 may be removed for replacement. Once the new blade is mounted, release the control button 256, the external force is absent from the bucking member 252, and the elastic force of the spring 251 moves the bucking member 252 to its original position, thus the stub 253 latches on the notch 261 to anchor the blade 26 again. Referring to FIG. 9, when there is a desire to apply a greater force on the body 2 for heavy duty cutting, remove the blade 26 according to the operations described in FIG. 8, reverse the blade 26 to turn the blade edge inverse, and insert the blade 26 into the body 2 so that the notch 261 of the blade is latched on the stub 253 on another side. Then the cutter knife may be gripped in reverse to apply a greater force to perform heavy duty cutting.

By means of the construction set forth above, the cutter knife of the invention has a simple structure and is easy to change the blade. It also allows users to grip the cutter knife in a positive or an inverse manner to overcome the limitation of conventional cutter knives that can be used in only one gripping method.

I claim:

1. An improved cutter knife comprising an upper shell and a lower shell that are coupled to form a body, the body having one end forming a handgrip conforming to ergonomics to allow positive and inverse gripping, the handgrip having a blade anchor section and a blade fast change section on one end thereof;

wherein the blade fast change section is located above the blade anchor section, the blade anchor section having a blade trough which has two sides extending to form respectively a lug which couples with a spring and a bucking member, the bucking member having a stub to latch on a notch formed on a blade, the bucking member further having a hole on another end apart from the stub to couple with two ends of a beam, the beam being depressable by a control button located thereabove, the control button has a lower side coupling with a spring which is housed in a hole formed on the upper shell;

wherein the blade is replaceable rapidly and the edge of the blade is turnable in an inverse manner to be inserted into the body such that the notch is engageable with each of the stubs located on two sides of the blade trough for anchoring the blade so that the handgrip is permitted to be gripped in an inverse manner to perform heavy duty cutting at a greater force.

2. The improved cutter knife of claim 1, wherein the bucking member is substantially formed in L-shape and located respectively on the lugs extending from two sides of the blade trough.

3. The improved cutter knife of claim 1, wherein the upper shell has a coupling section which has a bottom end forming a coupling strut to latch on a hook located on the lower shell for coupling the upper shell and the lower shell.

* * * * *